US006215883B1

(12) United States Patent
Leonarz

(10) Patent No.: US 6,215,883 B1
(45) Date of Patent: Apr. 10, 2001

(54) LOUDSPEAKER WITH MOVABLE VIRTUAL POINT SOURCE

(76) Inventor: Terry R. Leonarz, Wehntalerstrasse 178, Zurich 8057 (CH)

( * ) Notice: Subject to any disclaimer, the term of this patent is extended or adjusted under 35 U.S.C. 154(b) by 0 days.

(21) Appl. No.: 09/022,552

(22) Filed: Feb. 12, 1998

(51) Int. Cl.[7] ..... H04R 25/00
(52) U.S. Cl. ..... 381/182; 381/300; 381/386
(58) Field of Search ..... 381/300, 304, 381/307, 386, 387, 182, 186, FOR 125, 77; 181/143, 144, 145, 147, 199

(56) References Cited

U.S. PATENT DOCUMENTS 5,684,879 * 11/1997 Verdick ..... 381/300
5,781,645 * 7/1998 Beale ..... 381/300

* cited by examiner

*Primary Examiner*—Huyen Le

(57) ABSTRACT

A cinema sound production device, to be located behind screen, which will produce a phase-coherent spheroidally shaped superimposed wavefront which has an adjustable, determinable radius, thus possessing a stable psycho-acoustic virtual point source, which may move in a continuously variable manner from infinity to within the plane of the device, as well as in any 3 dimensional axis, thereby, with the use of a positioning track and a computer, being able to be keyed in cinematic post production to visual location as displayed on a screen.

6 Claims, 11 Drawing Sheets

LOUDSPEAKER WITH MOVABLE VIRTUAL POINT SOURCE

BACKGROUND OF THE INVENTION

My invention concerns interaural time delay of a direct sound superimposed wavefront as it is generated by a loudspeaker array and is perceived by the ears and brain to have a distinct spheroidal propagation and thus, a corresponding radius vector and thus, a psychoaccoustic virtual point-source, hereafter referred to as an image, in three dimensional space.

Space and source perception of human hearing in nature, as well as with reproduced sound, depend concurrently on at least four different parameters of acoustics which are received by the left and right ears and processed in the hearing center in the brain to identify a sound's point-source, not only as to direction, but also in rather exacting distance estimation, i.e. to find the radius vector of a given wavefront.

These four parameters, as long understood, may be listed as loudness (amplitude of a given soundwave); the acoustic ratio (ratio in amplitude of direct to reflected soundwaves); high frequency roll-off (absorption by the atmosphere of energy of shorter wavelengths); and finally, and most significant for image perception, time delay, or the relative difference in times of arrival of a given wavefront (at the same period of phase) at the two respective ears.

In order to explain the physics of creating an image one must note that time delay may be understood to exist in two regions of effect on human hearing. The proportion of the human interaural separation (approximately 15 to 21 cm.), to the audible wavelengths (which vary from approximately 1,720 cm. to 1.72 cm.) may fall into the region referred to as near-field, meaning an interaural phase-shift of time delay which is well within one full cycle of a given wavelength, and which is intelligible by the brain as to degree. On the other hand, this proportion may fall into the region referred to as far field, meaning a phase-shift of time delay which is greater than 360° (one full cycle of a given wavelength), or else very near 0° in the near field which is beyond comprehension to the brain with respect to the oncoming radius vector of a direct wavefront. This far-field proportion is, however, very useful for the spatial reconstruction of reflective walls and other surrounding surfaces in a recorded non-anechoic environment. This use of echo, which may be effective from 10 to 30 ms., is known as the Haas effect and is employed by the recording industry as the primary tool for building a "stereo" as well as "surround" soundstage.

On the other hand a direct oncoming wavefront received by the ears in an anechoic condition, i.e., with no reflective surround echo clues, may be subconsciously measured by the brain as to the phase-shift of the arrival times with respect to the tangent of the wavefront at the two ears. Although the difference may be as little as one tenth of a millisecond, in the near field region (which, with an interaural separation of 15–21 cm., lies between approximately 125 HZ (wavelength=275 cm.) and 1500 HZ (wavelength=23 cm.)), this delay may correspond to a comprehensible amount of phase shift (that is greater than 0° and less than 360°), which may be used to triangulate the angle of the oncoming wavefront to the head, using the following relationship:

$$\mathrm{Sin}\Theta = \frac{ct}{x}$$

where

θ is the arriving angle of the radius vector of the oncoming wavefront;

c is the speed of sound;

t is the time delay; and x is the distance between the ears.

Furthermore, by slightly "cocking" the head to the first found angle, the brain may refine this estimation in three-dimensional space, subconsciously and nearly simultaneously, triangulating several aspects of the wavefront, and thus, the curvature or radius, ie., with a flatter wavefront signalling a more distant point-source and more rounded wavefront signalling a nearer point-source.

DESCRIPTION OF THE PRIOR ART

Prior art (See particularly, U.S. Pat. No. 3,773,984) from Peter Walker of Quad Electroaccoustics Ltd, Huntingdon, England, provides for an arrayed loudspeaker, marketed as the Quad ESL-63 Electrostatic Loudspeaker, which involves a vibrating electrostatically charged thin membrane which is suspended in a plane between two like-dimensioned planar electrode grids which, in turn, are electrically segregated into an array of concentric annular segments surrounding a central circular section.

A mono signal drives the central section with no delay and then, in the fashion of a transmission-line loudspeaker (a parallel line of capacitors linked with inductance, which introduces a progressive amount of delay), drives the inner most ring-segment with a given amount of delay and then, each with an additional given amount of delay, drives each additional ring-segment outward from the center until the outer most ring-segment has been activated.

Thus, the superimposed wavefront generated by the Walker device propagates in a substantially spherical pattern which has a fixed radius and therefore may be perceived to describe an image which occupies a fixed and stable point in three-dimensional space, approximately two meters behind the loudspeaker device.

My invention, with the guidance of data on a positioning track and a computer processor achieves the creation of a stable image at a point in three-dimensional space at an arbitrarily chosen location behind (and including the plane of) the device and then provides means for shifting the location to any other arbitrary location behind the device.

SUMMARY OF THE INVENTION

A cinema sound reproduction device is described which when fed by an ordinary monaural input will produce a phase coherent spheroidally shaped wavefront which may be perceived by the listener as having a distinct image at an apparent point in three dimensional space, which is positioned some variable distance and direction behind the actual position of said device.

The architectural sub-structure of this invention may be implemented in different ways. One such implementation may be an articulated compound spheroidal hinge construction of multiple sixteen-sided polyhedra composed of only equilateral triangles of identical size. Each hinged polyhedron, in turn, may serve as a platform for the mounting of one or more identical lower-midrange conventional loudspeakers. All of the loudspeakers in the array are simultaneously driven in phase, producing wavefront elements which superimpose upon one another to form a combined, or superimposed, wavefront which is heard by an observer to emanate from a source point on the central axis of the array of loudspeakers, such that the distance of the source point is dependent upon the configuration of the articulated spheroidal hinge. The loudspeakers are arrayed in a spheroidal section which has one and only one focal point, and the sound from the loudspeakers in that spheroidal configuration appears to emanate from that focal point.

Alternatively the architectural sub-structure of this invention may be a fixed array of identical lower-midrange loudspeakers, sufficient in number to form a single center loudspeaker, plus other surrounding groups of loudspeakers, more or less concentric to the center loudspeaker, utilizing a calculated delay for each individual loudspeaker.

In this case, a processor executes mono signals which are fed to the center loudspeaker at minimum delay and then with progressive, calculated delays, successively to each loudspeaker toward and including the outermost ones.

In either form of architectural sub-structure, a phase-coherent superimposed spheroidal wavefront produced by said individual loudspeakers may be varied with respect to radius in a continuous way to define a predetermined apparent point in space as the virtual point source, or image, of the wavefront, and then, when the radius is varied, a different apparent point in space becomes the new virtual point source.

This is a psychoacoustic image. It may be seen (or heard) to be the radius of the spheroidal wavefront. It may be located anywhere behind said device from infinity to within the plane of the device.

The perceived position of the image, whether stationary or in motion, may be made to correspond with the visual spatial location or movements of cinematic characters and/or objects on the cinema screen to be perceived by a viewer to emit a given sound. This may be accomplished in cinematic post production with a synchronized positioning track affixed directly onto the film.

Also, the lateral position of an image need not necessarily be centered on said device. In the case of the articulated compound spheroidal hinge variant, the device may be made simply to tilt obliquely with respect to the plane of the screen, and then the image will correspondingly be heard to move laterally, and/or vertically, in accordance with the movement of the central axis of the speaker array.

With the fixed-array variant of my invention, the signal may be regulated by a computing processor to choose any predetermined point within the array as the center and consequently to feed surrounding groups of loudspeakers within the array with calculated progressively delayed signals until the outermost group or segment, as needed to emulate the desired sound wavefront. This shifts the apparent source position of the image laterally and/or vertically in accordance with calculations based upon the predetermined source point in three-dimensional space.

The actual calculation is fairly straightforward. A sound wavefront emanating from an arbitrarily predetermined point in space expands from that point spherically at the speed of sound. The three-space location of all of the points along the sphere at any instant of time can be calculated given the instant in time at which a sound may be thought to have emanated from the virtual source point, and the elapsed time associated with the desired wavefront. Emulating that sound wavefront from a different point in space with a group of speakers is done by letting each speaker contribute an element to the emulating wavefront at the appropriate time so that the totality of the contributed elements superimpose upon one another to form the desired wavefront. To emulate that hypothetical original sound wavefront from an array of speakers, one calculates the respective delays necessary at each of the individual array speakers for that speaker's contribution to the emulated wavefront.

As may be seen with reference to FIGS. 19 and 19*a,* from some arbitrary point "p" in space behind a planar array of speakers, a line is extended to the nearest point "a" in the plane of an array of speakers (to assume a planar array is convenient for calculation, but not necessary for practice of the invention). It may be seen that a sound wavefront from "p" would pass first at the point "a" in that array. Therefore, the delay for a speaker at "a" would be zero. With respect to the delay "delta t" for activation of a speaker "B" at a point "b" in the planar array, it may be seen that the points "p," "a," and "b" form a right triangle such that the distance "pb" is the hypotenuse and "pa" is, with respect to the angle "bpa," the adjacent side. Thus, the relationship of "pb" to "pa" is the secant of the angle "bpa." So, if the time taken for the sound originating at "p" to reach the nearest point in the array "a" is one, then secant "bpa" minus one, divided by the speed of sound, gives the delay "delta t" for the speaker at "b."

$$\delta t = \sec bpa - \frac{1}{c}$$

Thus, to emulate a sound wavefront from "p," it is only necessary to calculate the respective "delta t"s for each speaker in the array, and activate each at its appointed time. If "p" changes, all the calculations are done again for the new "p" and a different set of activation instructions is dispatched to the respective speakers.

Of course, mounting my compound variable-radius hinge speaker device in a universal mount for rotation about both vertical and lateral axes, automatically emulates a sound wavefront from a virtual point on the central axis of the compound variable radius device, located at a distance down that axis which is determined by the degree of curvature, i.e., convexity, of the loudspeaker configuration, when all of the speakers are activated in phase. Using servo motors to control the rotations of the universal mount and the curvature or convexity of the hinge device, allows for automatic operation and swift movement of the device from configuration for emulation of a sound wavefront from a first virtual point to configuration for sound from a second virtual point.

Supplying the necessary data for a full system utilizing a device or devices described in this invention may be accomplished by printing the positioning data in a digitized form directly onto the film, or by means of an external device carrying the sound source-point data to drive the loudspeakers by some synchronized means to correspond with the action on the film. From this data, all calculations can be made and activation signals provided to each respective speaker as necessary to emulate each respective wavefront as necessary to follow the visual spatial location as perceived on the screen.

DETAILED DESCRIPTION OF THE INVENTION

Figure 1:
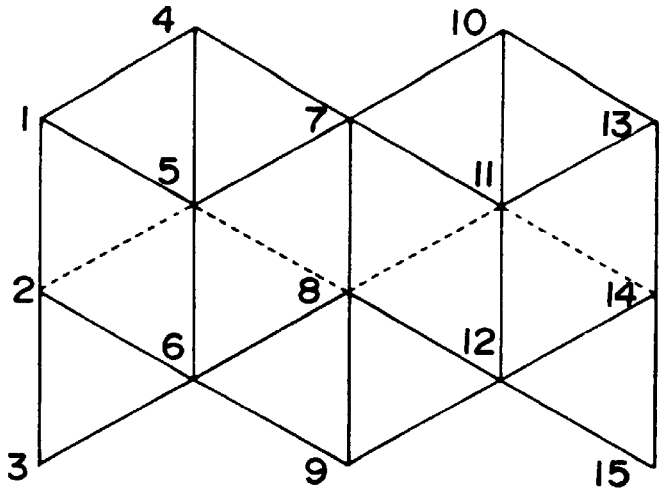
FIG. 1 is a blank of a sixteen sided polyhedron, with (1–15) being vertices of identical equilateral triangles.
Figure 2:
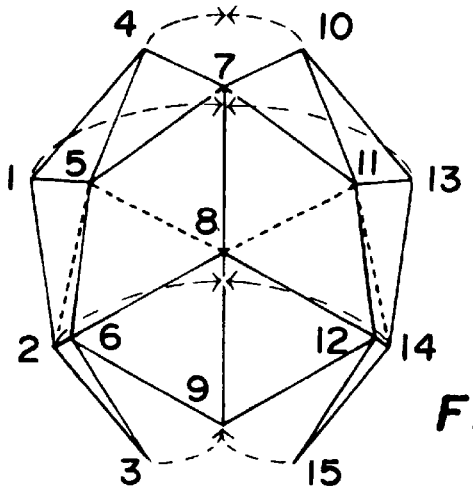
FIG. 2 shows how the blank is folded to form the polyhedron unit, with broken lines indicating "valleys" and solid lines forming "ridges."
Figure 3A:
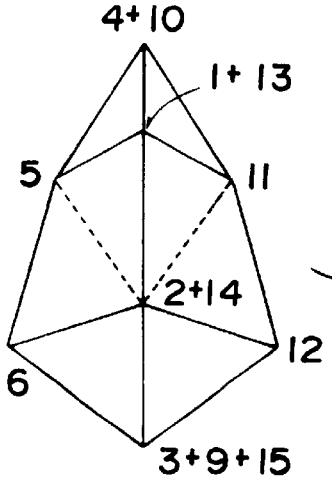
FIG. 3 shows three successive views (a,b,c) in elevation at 45° intervals of the polyhedron unit as it rotates about the longitudinal axis defined by (4+10), (3+9+15).
Figure 3B:
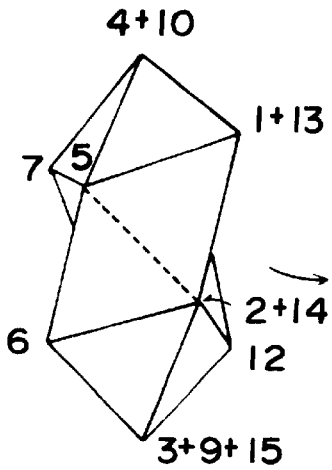
Figure 3C:
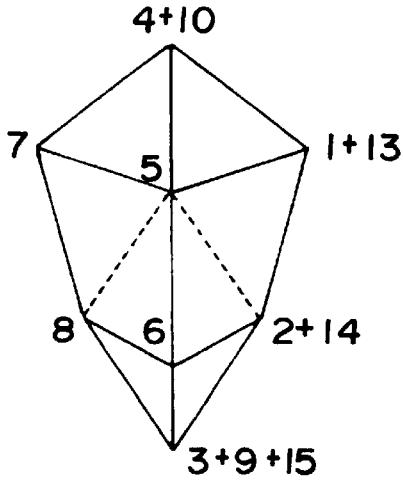
Figure 4A:
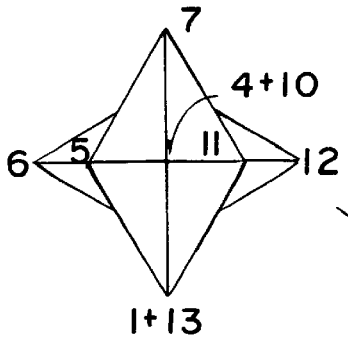
FIG. 4 shows three views (a,b,c) in plan of the polyhedron unit in FIG. 3.
Figure 4B:
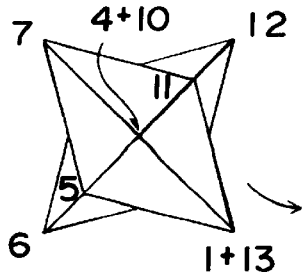
Figure 4C:
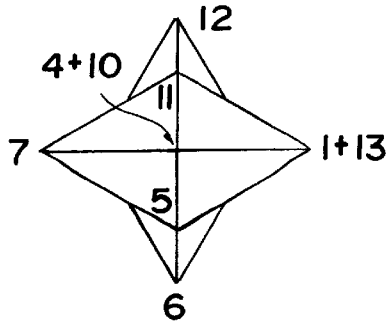

With respect to FIGS. 1–3, a structural-unit in the form of a sixteen sided polyhedron may be formed from a blank as shown in FIG. 1. The structural unit is formed by folding the two edges 1–3, 13–15 toward each other along lines 4–6 and 10–12, and sealing at 1+13, 2+14, 3+15. The blank is now half as wide as when unfolded and still the same length. Now a convex end 6, 3+9+15, 12 and a concave end 4, 1+7, 10 are observed, which are sealed such that the convex end 6, 3+9+15, 12 seals as it naturally falls in place, and the concave end must be pinched together at points 5, 11 so that edges 7, 4+10, 1+13 seal at a right angle to sealed edges 6, 3+9+15, 12.

A resulting polyhedron as in FIG. 3 has an axis of symmetry referred to as the longitudinal axis 4+10 to 3+9+15 about which there exists at every 180 degree revolution congruity and at every 90 degree revolution there exists congruity which is reversed with respect to the axis 4+10 to 3+9+15.

The angle formed by that axis and each of four edges (1+13 to 4+10), (4+10 to 7), (6 to 3+9+15), and (3+9+15 to 12) is substantially 54.27° and the angle between edges (1+13 to 4+10) and (4+10 to 7) or (6 to 3+9+15) and (3+9+15 to 12) is substantially 108.55°. These four edges are used for mounting hinges when the structural unit is assembled into a compound hinge.

There are twenty-four edges formed by sixteen facets. Four edges (5 to 2+14), (2+14 to 11), (5 to 8) and (8 to 11), are concave, or "valleys." All other edges are convex or "hills."

One can also form a structural unit of this invention by fastening together 12 equilateral triangles of the same size in the form shown, or such a structural unit could be carved from solid materials, or molded, vacuum-formed, or otherwise created.

Figure 5A:
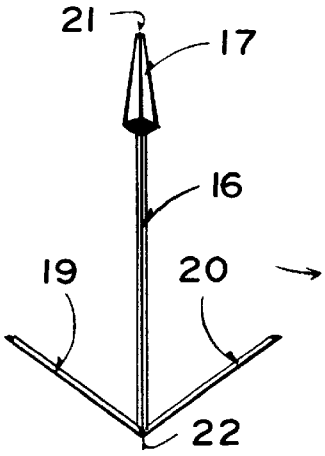
FIG. 5 shows three successive views (a,b,c) in elevation at 45° intervals of a rigid crossbar structural unit which may be alternatively used in place of the polyhedron unit of FIGS. 3 and 4.
Figure 5B:
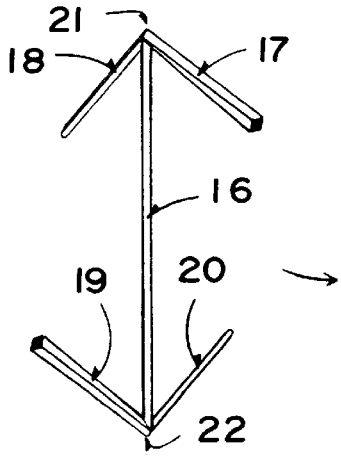
Figure 5C:
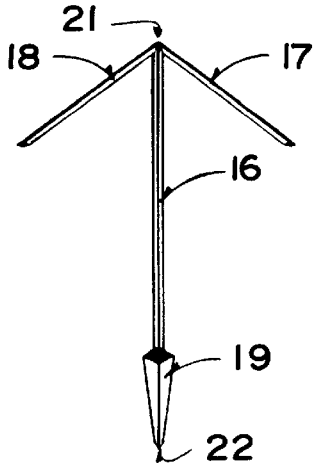

An alternative structure which is architecturally interchangeable with a polyhedron of FIG. 3, and which is therefore identical for structural purposes when assembling a compound lever, is shown in FIG. 5, which consists of a central longitudinal bar 16 and two pairs of contiguously angled bars 17, 18, and 19, 20.

Figure 6A:
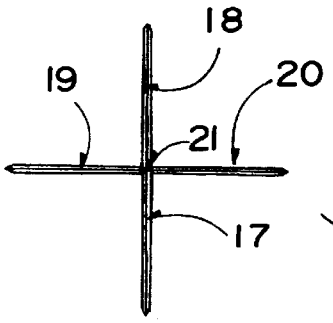
FIG. 6 shows three views (a,b,c) in plan of the rigid crossbar structure of FIG. 5.
Figure 6B:
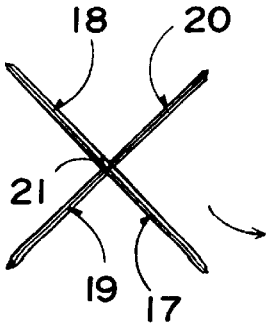
Figure 6C:
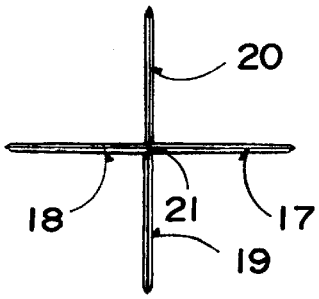

As seen in FIG. 6, each bar pair is offset perpendicular to the other as viewed along said longitudinal bar 16. The angle within each pair is substantially 108.55°, and the angle of each bar 17, 18, 19 and 20 with said longitudinal bar is substantially 54.27°.

Material used for construction of said crossbar must allow for rigid joining, such as welded steel, as the bars act as hinge edges within a multiplicity of these crossbar structures in order to form my articulated compound spheroidal hinged compound lever, whereas with the polyhedron structure, structural integrity is afforded by its rigid, geometrically structured form.

It may be readily observed that it is feasible to construct the polygon structure with a reinforcing crossbar structure, or other skeletal structure, within the polygon, to afford greater flexibility in the choice of materials for fabrication of the polygon and to provide purchase for the mounting of hinges along the hinging surfaces.

Assembly of a twelve-unit compound hinge is shown in the several views of FIG. 7. In FIG. 7*a* all twelve units are shown exploded and separated from one another, but in the correct orientation for joinder along their common hinging edges. The central four units, when fully assembled have vertices 21 which are to be assembled together to a common point 21. The leftmost two of the central four have vertices h which are to be assembled together to form a common point h. Similarly, the rightmost two of the central four have vertices h', which are to be assembled together to form a common point h' on the fully assembled 12-unit device. The points h and h' are drawn horizontally toward or apart from one another as part of the means for controlling the amount of excursion and configuration change of the 12-unit device.

As with the horizontal vertices h and h', the uppermost two of the central four units have vertices v which are to be assembled together to form a common point v. Also, the lowermost two of the central four units have vertices v' which are to be assembled together for form a common point v'. The points v and v' are drawn vertically toward or apart from one another as the other part of the means for controlling the amount of excursion and configuration change of the 12-unit device.

Figure 7A:
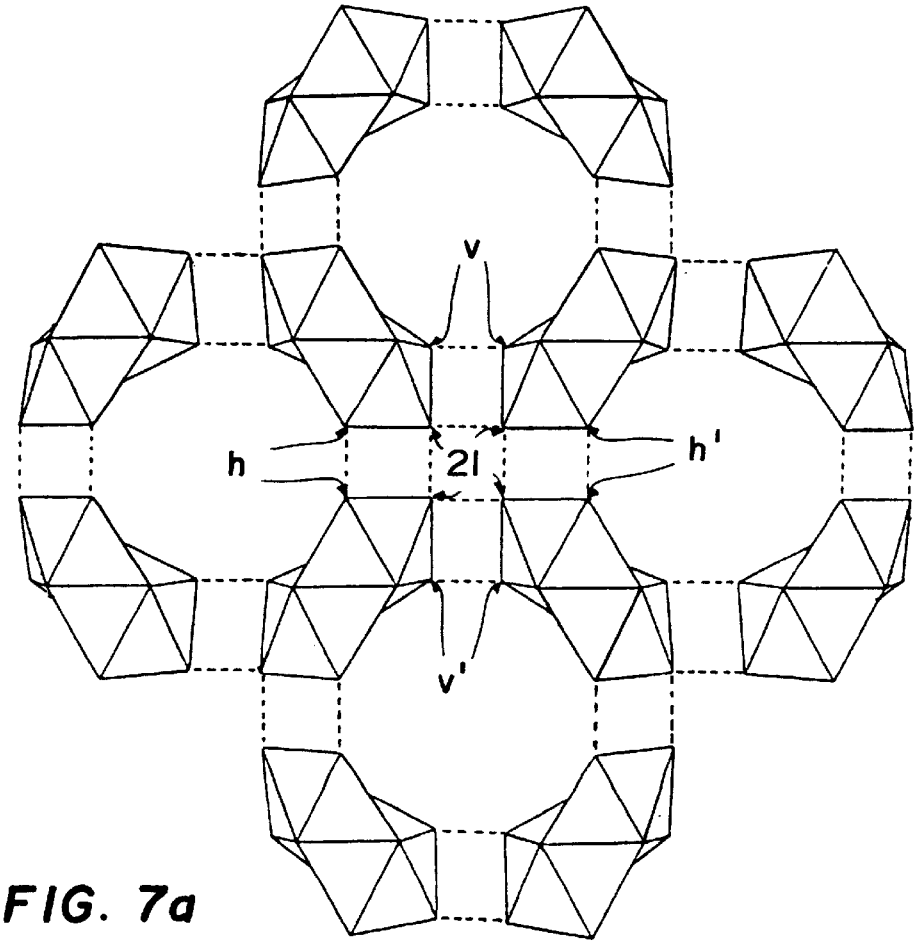
FIG. 7 shows five plan views of multiple assemblies of the polyhedron units of FIG. 3, in (a) exploded view of 12 polyhedron units, (b) exploded view of four units, (c) exploded view of two assembled hinged groupings of four units each, (d) exploded view of the assembled hinged grouping of eight units seen in (c), with four additional units, and (e) a fully assembled hinged grouping of twelve units, in a substantially planar configuration.
Figure 7B:
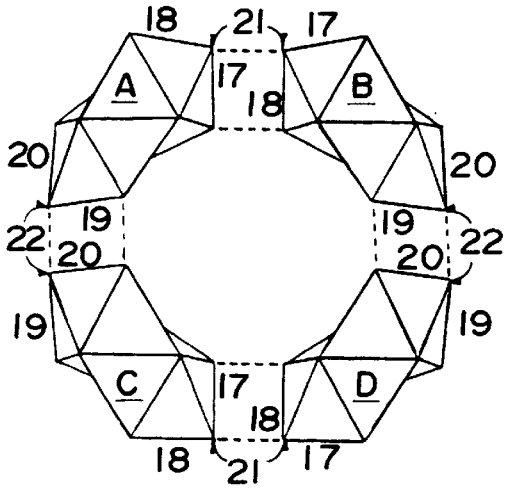

FIG. 7*b* shows four units, A,B,C,and D, which are to be hinged together so that A's edge 17 is hinged to B's edge 18. B's edge 19 is hinged to D's edge 20. D's edge 18 is hinged to C's edge 17 and to complete the loop, C's edge 20 is hinged to A's edge 19.

Figure 7C:
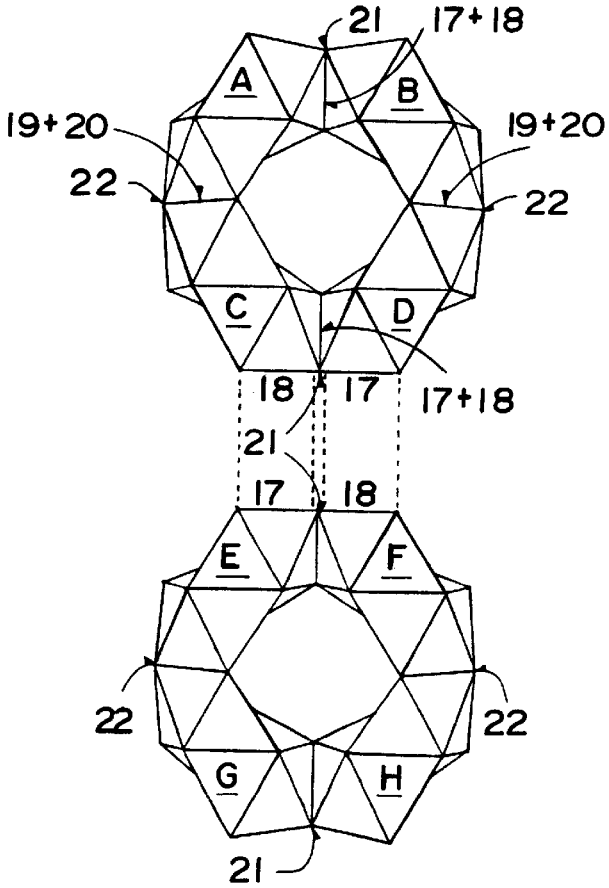

FIG. 7*c* shows two four-units, ABCD and EFGH, each hinged together as shown in FIG. 7*b,* ready to be hinged together into an eight-unit device, by hinging E17 to C18 and F18 to D17, thus bringing the vertices 21 of units C, D, E, and F together to make a central point 21 in the eight-unit assembly.

Figure 7D:
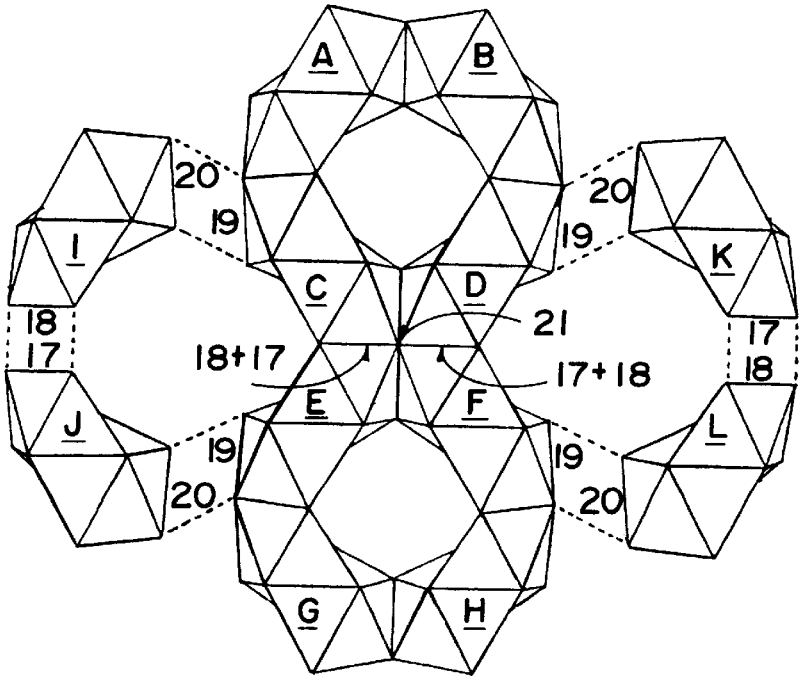

FIG. 7*d* shows four additional single units I, J, K and L ready for hinged assembly to each other and to the eight-unit of FIG. 7*c*, such that I's edge 18 is hinged to J's edge 17, then I's edge 20 is hinged to C's edge 17 while J's edge 20 is hinged to E's edge 19. Finally K and L are hinged at K 17 and L 18, and then the 12-unit assembly is completed by hinging K20 to D19 and L20 to F19.

Figure 7E:
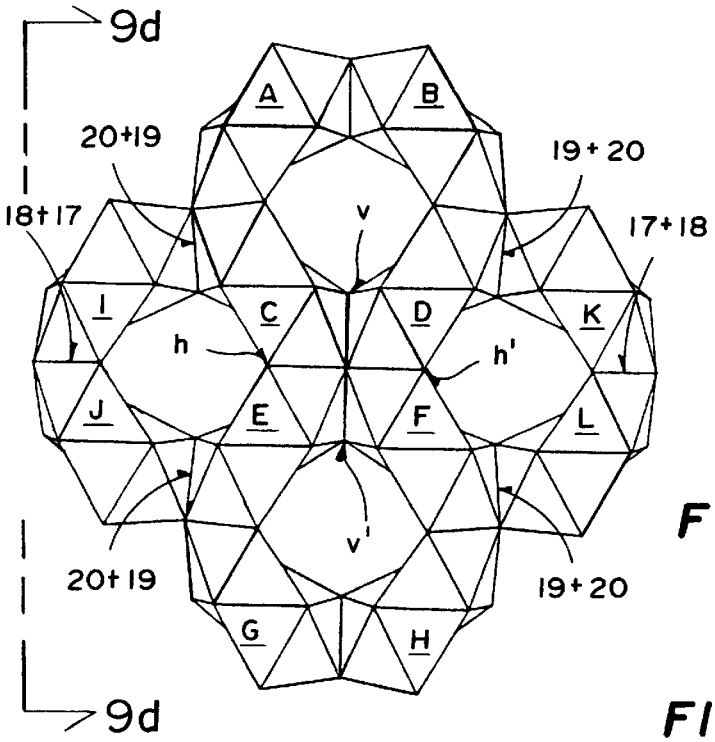

FIG. 7*e* shows the fully hinged/assembled 12-unit ABCDEFGHIJKL configured in a substantially planar configuration, with the points h and h' and v and v' now established by the assembly process.

Figure 8:
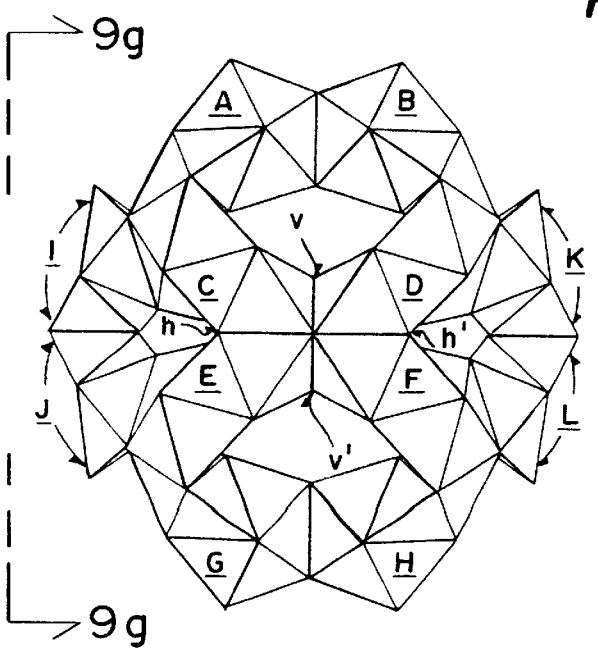
FIG. 8 shows the fully hinged grouping of twelve units seen in FIG. 7 (*e*), flexed in a convex configuration toward the viewer.

FIG. 8 shows the 12-unit from above, as in FIG. 7*e*, but reconfigured into a convex configuration with CDEF closest to the viewer and IJKL farthest away. FIG. 8 may be seen to correspond to FIG. 9*g* if FIG. 9*g* were seen from below.

Figure 9A:
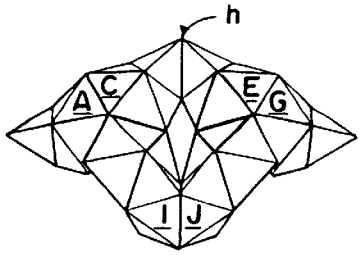
FIG. 9 shows seven successive views (a,b,c,d,e,f,g) in side elevation of the hinge structure in FIG. 7 (*e*) as it flexes from an extreme convex configuration, FIG. 9 (*a*), through a planar state, FIG. 9 (*d*), and on to an extreme concave configuration, FIG. 9 (*g*).
Figure 9B:
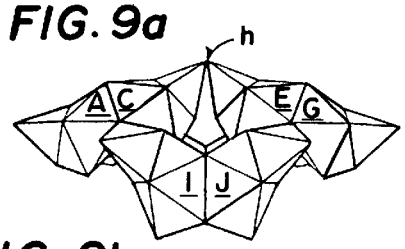
Figure 9C:
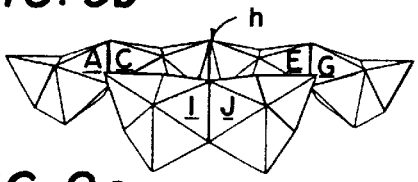
Figure 9D:
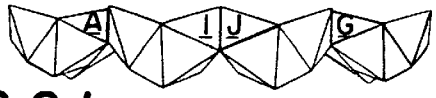
Figure 9E:
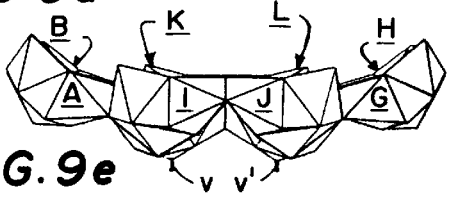
Figure 9F:
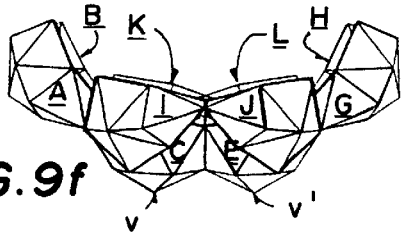
Figure 9G:
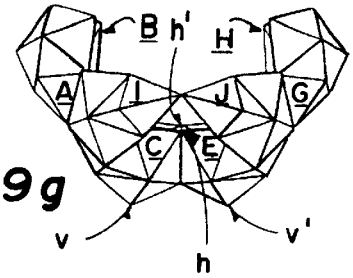

FIG. 9 is a series of seven side views of a 12-unit of my invention as it flexes through a series of configurations, from the fully concave in FIG. 9*a* , stepwise to a substantially flat configuration in FIG. 9*d* , and finally to a fully convex configuration in FIG. 9*g*.

There are natural limits to the respective degrees of concavity or convexity, which are reached, respectively, when adjacent faces of the four central structural units meet mechanically in the process of being flexed together.

The addition of more units to a matrix of twelve, as for example, three groups of twelve units hinged together, may form a more complete spheroidal section, however, due to mechanical interferences, the spheroidal sections of such matrices are limited to the longer radii.

A single group of twelve units provides substantially a one-third spheroid section in extreme concave or convex orientation.

There are a multitude of potential uses for a compound hinge structure, as described above. Such a structure may act as a platform to mount various devices which radiate or receive energy waves, thereby affording the ability to mechanically "focus" and enhance certain properties of such energy waves.

For instance, a device may be constructed which may propagate sound wavefronts by radiating them outward from said device, e.g., convexly. Such a device may also receive soundwaves in a concave orientation, from an external sound source, providing for an adjustable phase-reading microphone device. Thus, a specific point may be physically located in space and be recorded or reproduced through the use of digital processing of discreet phase-coherent, superimposed sphere sections.

Figure 10:
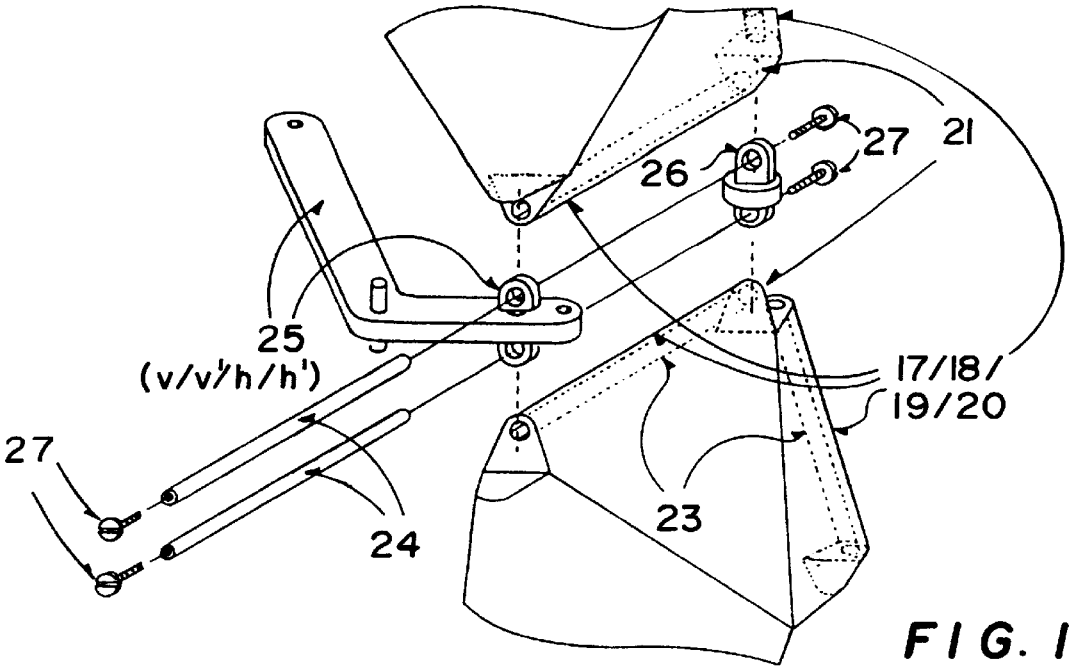
FIG. 10 shows hinging detail for joinder of hinging edges of polyhedron units, and how control levers may be connected.

In FIG. 10 a means for hinging edges of polygons is shown. The hinging edges 17/18/19/20 are bored through end to end with sleeve channels 23. Fulcrum rods 24 are inserted through the sleeve channels 23 and the respective holes in the eyelets 25 and 26. The eyelet 25 is part of lever 25, four of which, as will as will be seen, are used in causing flex movements of the finally assembled variable radius device. The eyelets 25/26 are secured to the fulcrum rods 24 by screws 27. Hinging motion is therefore obtained by rotation of the eyelets 25/26 relative to the fulcrum rods 24 so that two adjacent polyhedra are constrained to move relative to one another only through a plane which is orthogonal to the fulcrum rods 24.

Figure 11:
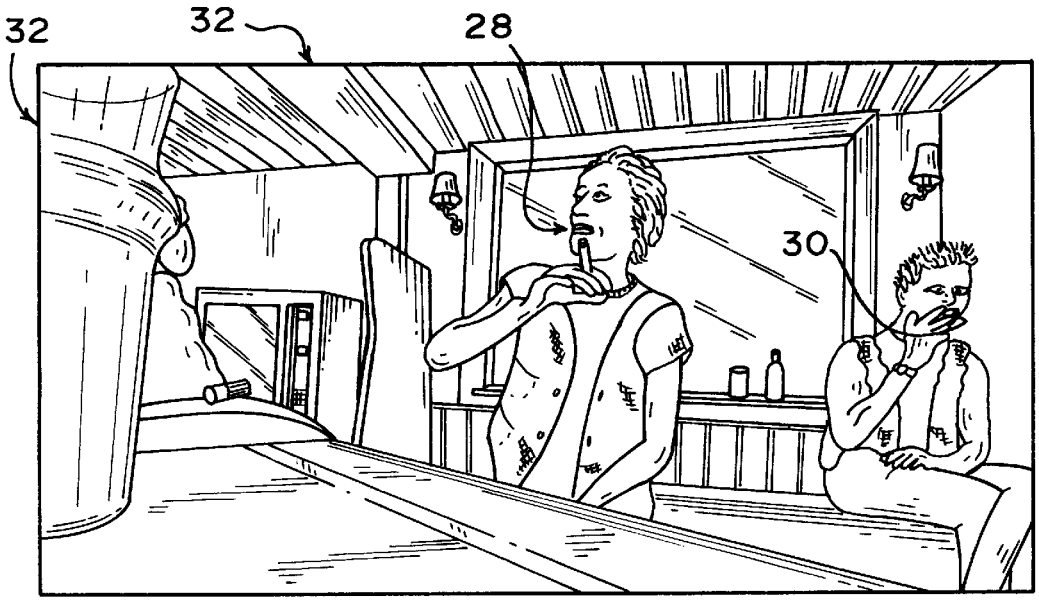
FIG. 11 is a frame from a cinematic film.
Figure 12:
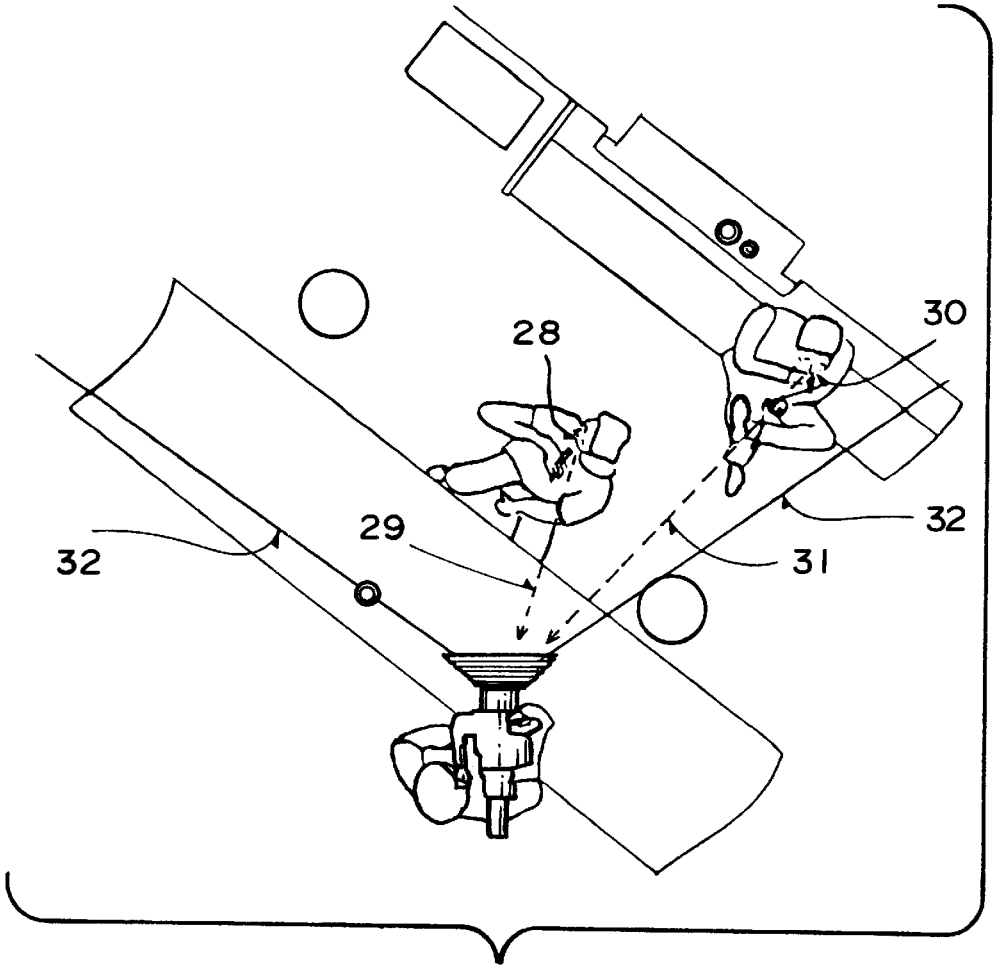
FIG. 12 is a plan diagram of the scene in FIG. 11.
Figure 11A:
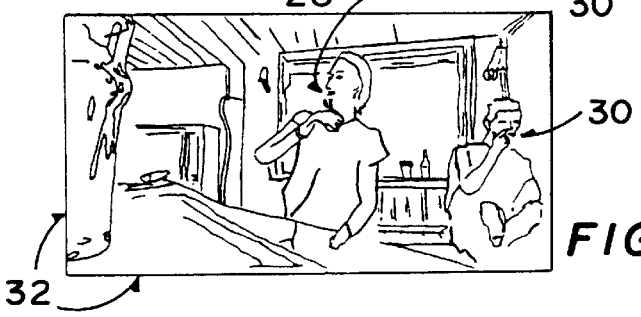
FIG. 11*a* is a diagram of the scene in FIG. 11.

FIGS. 11, 11*a* and 12 depict a cinematic film frame with two persons speaking respectively from virtual point sources 28 and 30. FIG. 11 is a depiction of the cinema screen 32. In FIG. 11*a* the same scene is related to FIGS. 18, 19 and 20 to show how the virtual point sources 28/30 appear in the respective contexts of a coplanar array of speakers (FIG. 18), a diagram of the locational relationship of the virtual point sources 28,30 to the coplanar array of speakers (FIG. 19), and the speaker array in a hypothetical theater (FIG. 20).

As best seen in FIG. 12, two actors 28, 30 appear in the field of view 32 of a camera. Radius vectors 29/31, trace the path between the actors (virtual point sources) 28/30 and the camera, and illustrate, in plan, the geometry of the cinematic scene and the sound sources which appear within it.

Figure 13A:
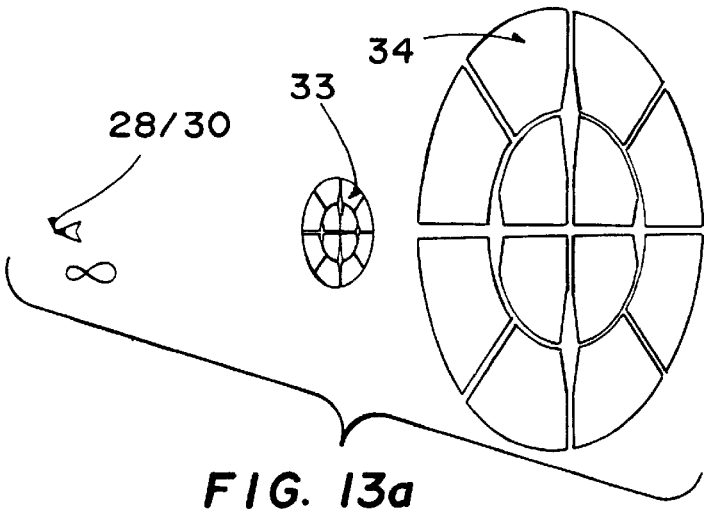
FIG. 13 shows three successive diagrammatic perspective views, respectively, of a virtual point source, the hinged assembly of polyhedron units with loudspeakers mounted thereon, and a superimposed phase-coherent spherical sound wavefront emanating from the loudspeakers.
Figure 13B:
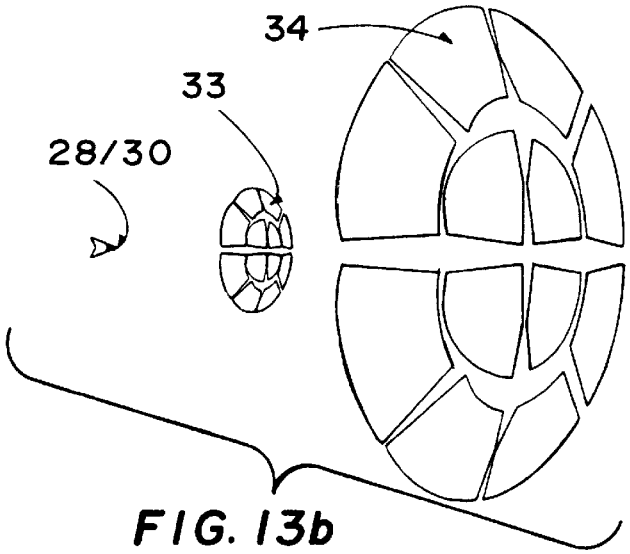
Figure 13C:
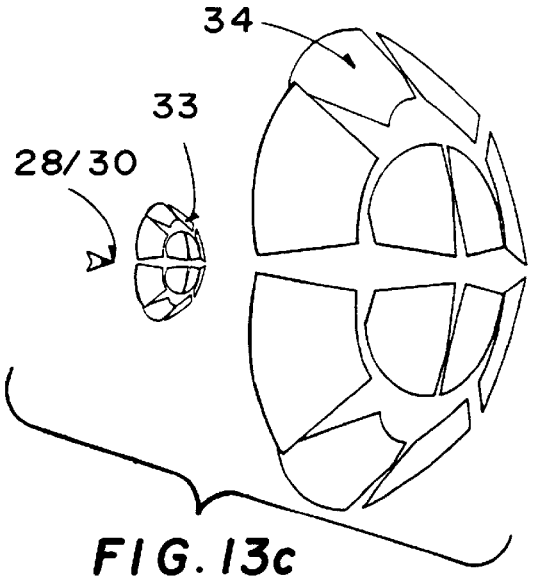

FIG. 13 illustrates 3 successive diagrammatic views of a loudspeaker array 33 and a corresponding sound wave front 34, as it might appear with a virtual point source 28/30 far away, at virtual infinity (FIG. 13*a*), more closely located (FIG. 13*b*) and quite near (FIG. 13*c*). For each one of an infinite number of distances down the central axis of a loudspeaker array mounted on a variable radius hinged mount according to my invention, there is one and only one configuration of the hinged mount, and of the loudspeakers mounted thereon, which will produce individual sound waves from each speaker in the correct combination to be superimposed on one another to form a single resultant sound wavefront which emulates a sound wavefront which would come from that point. The greater the degree of curvature, or convexity, of the hinged mounting structure (typically a 12-unit of my invention), the nearer a listener would perceive the virtual point source to be. Conversely, the more nearly the hinged mount approaches flatness (i.e., the longer the radius of the spheroidal section of the hinged mount), the farther away the sound would appear to an observer standing in front of the mounted loudspeaker array.

Figure 14A:
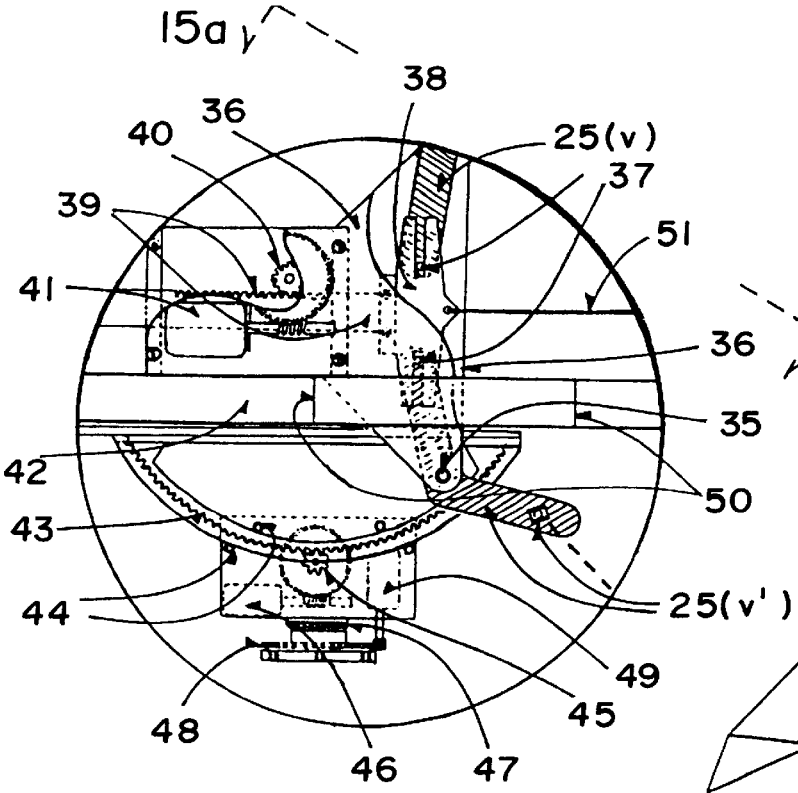
FIG. 14 is a side view, partially cut away, and partially exploded, of a configuration control mechanism for a twelve-unit assembly of polyhedrons, with loudspeakers mounted thereon, with an enlarged section in FIG. 14*a*.
Figure 14:
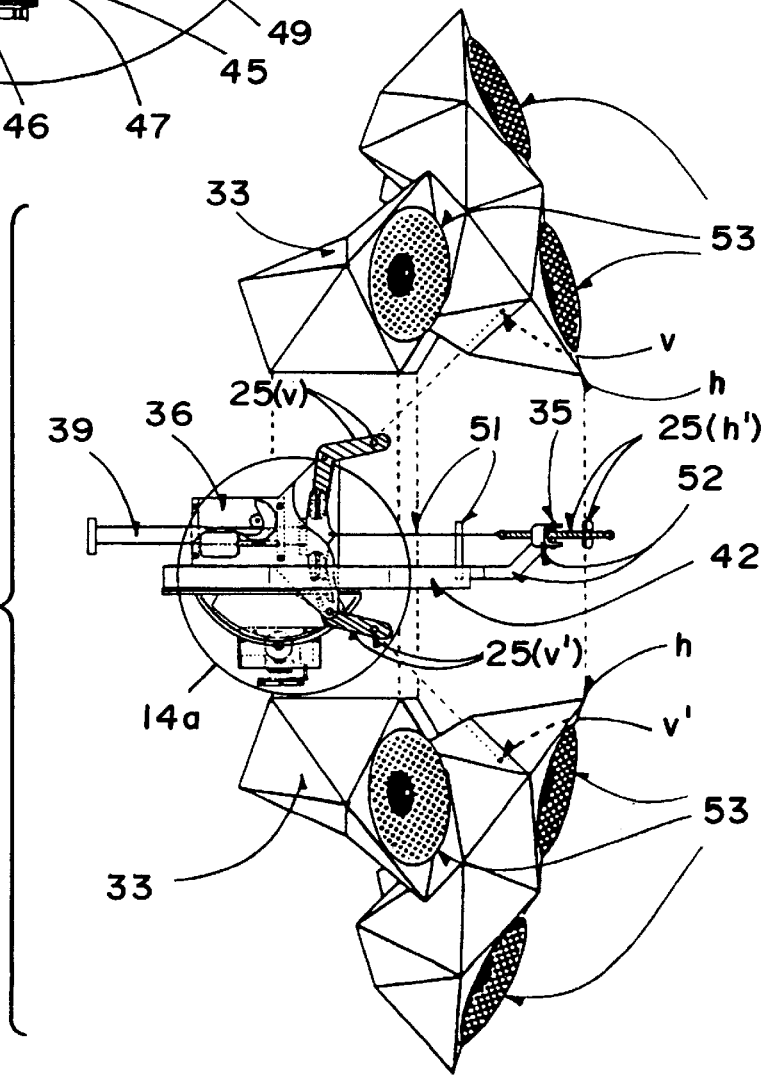

A mounting and control mechanism for a twelve polygon unit loudspeaker mounting array is shown in FIGS. 14, 14*a,* 15 and 15*a.*

The entire apparatus is mounted by means of a geared main mounting plate 48, which holds a ball-bearing pivot 47 which is tied to a roller bearing housing 44. Mounted within the roller bearing housing 44 is servo motor and pinion 49, the teeth of which are engaged with the main mounting plate gear 48. It may therefore be seen that azimuthal movement of the device around its vertical axis is achieved by activating the servo-pinion 49 to drive against the stationary geared mounting plate 48.

Also mounted within the roller bearing housing 44 is pinion gear assembly 45 which includes a small pinion engaged with teeth of a curved geared head 43, and further includes a larger gear which is engaged with the servo worm gear 46, which is fixed in the housing 44. Thus it may be seen that activation of the servo worm 46 drives the pinion gear assembly 45 to that the small pinion, in turn, drives the gear head 43 radially guided by roller bearings which are held by the roller bearing housing 44.

The geared head 43 is rigidly attached to the base plate 42 with carries the loudspeaker mounting array and the mechanism by which the array curvature is controlled. Thus activation of the servo worm 46 to drive the pinion gear assembly 45 and the geared head 43, moves the entire loudspeaker mounting array about its horizontal axis.

It may now be seen that movement of the central axis of the loudspeaker mounting array is under the control, in terms of elevation above or below a horizon, of the servo worm 46, and in terms of azimuth, to the left or right of a straight-ahead centered position, of the servo pinion 49. As those two servos are activated to drive the mounting array, the central axis of the array may be pointed to any spot, left or right, up or down, behind the array, which includes coverage of any virtual point source of sound which one might wish to emulate.

Fixed upon the base plate 42 is the servo-worm assembly 41. The worm is engaged with teeth of a gear-pinion assembly 40 which is journalled into the housing plates 36. The teeth of the pinion portion of the gear-pinion assembly 40 are engaged with the sliding geared rack 39. The rack 39 is attached to guide head 38. Pins 37 which are fixed in the vertical levers 25 are slidably engaged in slots in the guide head 38. The vertical levers 25 are pivotably constrained by spindles 35 which are fixed to the housing plates 36. As previously discussed with reference to FIG. 10, the levers 25 are attached at their outer ends to eyelets 26 at the points of the hinged array designated v and v'.

It may therefore be seen that activation of the servo worm assembly 41 drives the gear-pinion 40 to move the rack 39 and the guide head 38 so as to move the levers 25 by their guide pins 37, to pivot about the spindles 35, causing movement of the eyelets 26 at points v and v' to change the curvature of the 12-unit polygon speaker mounting array.

Figure 15A:
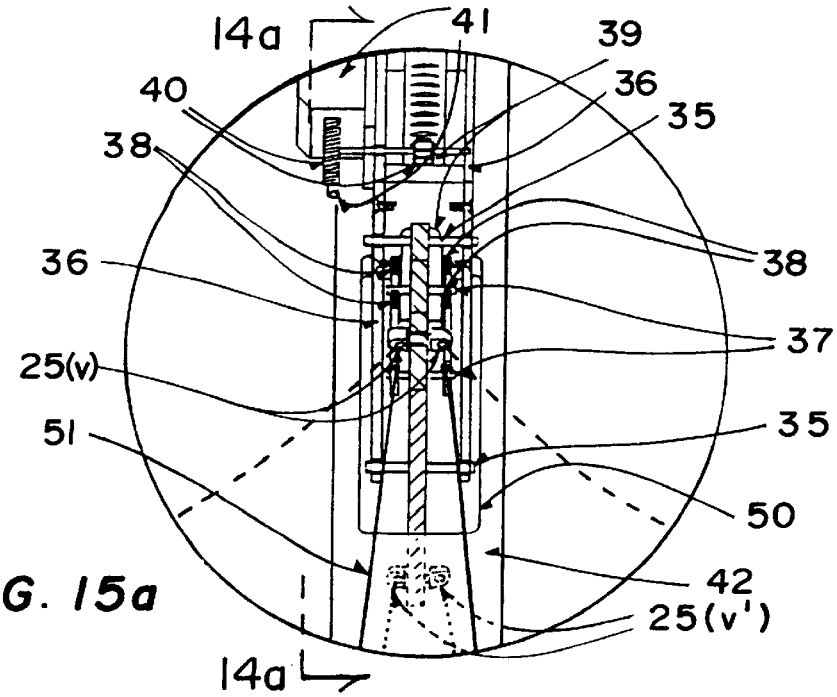
FIG. 15 is a top view of the configuration control mechanism of FIG. 14, with an enlarged section in FIG. 15*a*.

As best seen in FIGS. 14*a* and 15*a,* the housing plate 36 and its attendant lever 25, spindle 35, etc., extend below the level of the mounting plate 42, through a cut-out 50 in the mounting plate 42.

Figure 15:
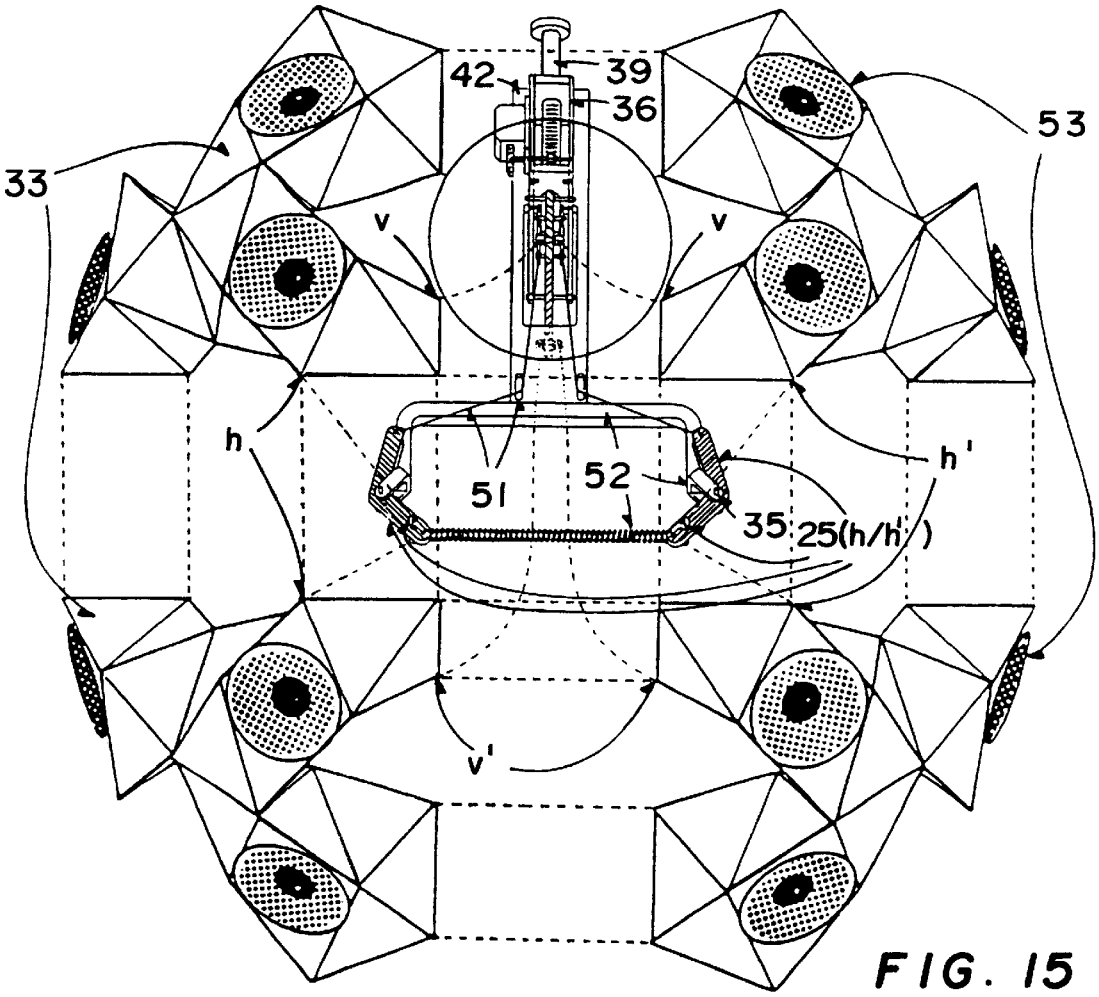

Horizontal levers 25, best seen in FIG. 15, are provided to connect (as shown in FIG. 10) with the points h and h' of the 12 unit polygonal array. The levers 25 (h/h') are pivotably held in a bracket and counterforce spring assembly 52, one end of each lever 25 (h/h') held by the spring, and the other end of each lever 25 (h/h') connected by the transverse cables and posts back to the guide head 38, with consequent opposite forces applied to horizontal levers 25 and vertical levers 25.

Thus the entire process of opening (toward a flatter configuration and a longer radius) and closing (toward a more convex configuration and a shorter radius) is effected by activation of the servo worm 41 which drives the gear-pinion assembly 40 to drive the rack 39 and guide head 38 to cause the near ends of the levers 25 (v/v') to pivot around the spindles 35 and draw the points v and v' (1) toward or (2) away from one another, thereby causing the array to (1) close or (2) open, forming a new and different spheroidal section which is of, respectively (1) shorter or (2) longer radius. While control of the curvature of the array is achieved by controlling the points v/v', it is useful to provide a counterforce spring to hold the points h/h' stable and secure during changes in the configuration of the array, under control of concurrent, but opposite movements of the vertical levers 25 (v,v') and, through the transverse cables and posts 51, the horizontal levers 25 (h/h') with the bracket and counterforce spring 52.

Figure 16:
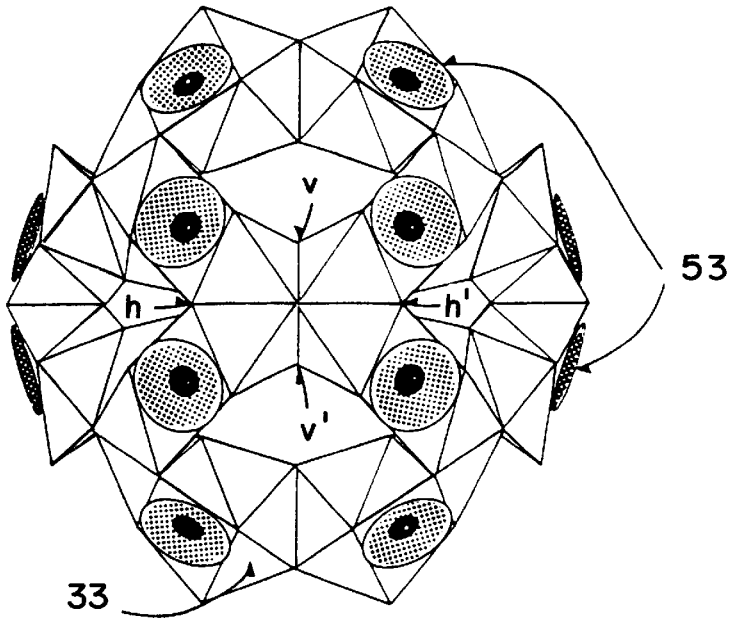
FIG. 16 is a loudspeaker array formed from a hinged assembly of 12 polyhedron units.
Figure 17:
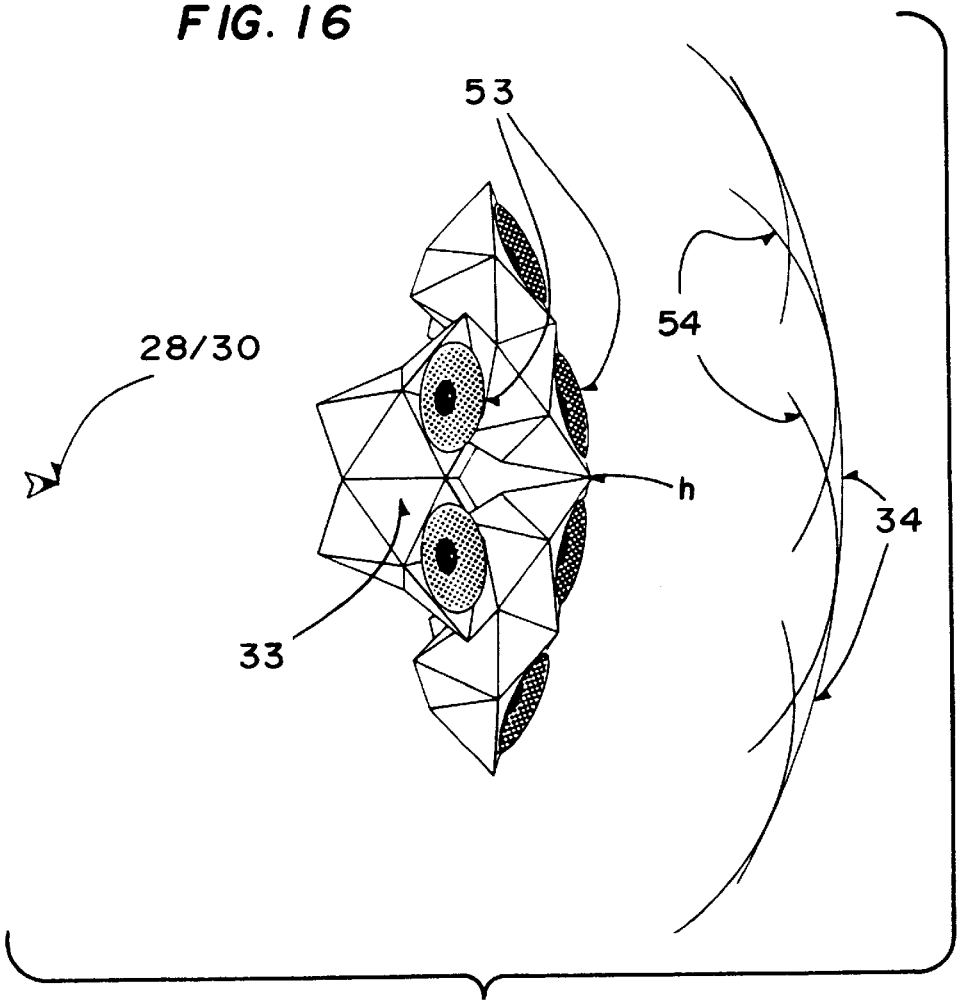
FIG. 17 is a side view diagram of the loudspeaker array of FIG. 16 showing a virtual point source, the array and a superimposed phase coherent wavefront.

As may now be seen in FIGS. 16 and 17, a 12-unit, hinged, polygonal array 33 of my invention, having been positioned according to a specific predetermined configuration through the mechanisms described above with respect to FIGS. 10, 14, 14*a,* 15 and 15*a,* may now, by substantially simultaneous activation of the individual speakers 53, produce a collection of individual sound wavefronts 54, which superimpose upon one another to form a new, single wavefront 34 which emulates a wavefront which appears to an observer (generally somewhere in front of the speaker assembly) to have come from a virtual pint source 28/30 located on the axis of the array 33 at a point whose distance down that axis (behind the array 33) corresponds exactly to the degree of curvature, or convexity, predetermined for the array 33.

It may be further seen that activation of the respective servos 49, 46, and 41, by appropriate control signals can drive the array 33 into any desired configuration, corresponding to any virtual point source generally behind the array 33. The physical system for electrical supply and control signals to the servos is entirely conventional and is not further detailed.

I have now established means by which, with a variable radius, spheroidal-sectioned array 33 of speakers 53, as shown in FIG. 17, a superimposed wavefront 34 can be made from the contributions of individual speakers, each providing its contribution according to a predetermined arrangement of azimuth, elevation and array curvature, which corresponds to a particular, virtual-source point in space.

Figure 18:
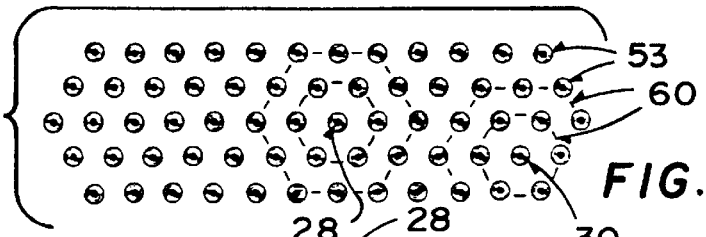
FIG. 18 shows a front view of a fixed planar array of loudspeakers.

Another means by which a superimposed wavefront 34 can be provided from contributions of individual speakers 53, particularly in a cinematic setting, is shown in FIGS. 18, 11*a,* and 20. Speakers 33, seen in FIGS. 18 and 20, are provided, presumably, but not necessarily, in a coplanar array. Sounds emanating, according to the story line of the film, from each of two actors, originate from virtual point sources 28, 30, seen straight-on in FIG. 18, as the actors appear on-screen in FIG. 11*a,* and in plan view of a cinematic theater in FIG. 20. Each speaker 33 is under centralized control for individual activation at a time appropriate to the making of its individual contribution to the superimposed wavefront 34.

Figure 19:
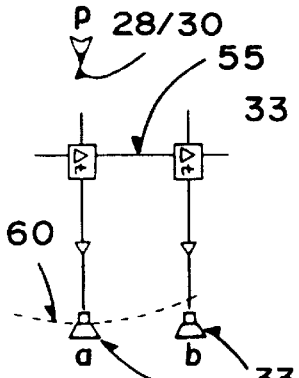
FIG. 19 is a diagram showing a virtual source, two loudspeakers from the array of FIG. 18 and control units.
Figure 19A:
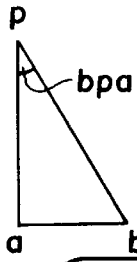
FIG. 19*a* shows a triangle formed by two speakers and a virtual point source.
Figure 20:
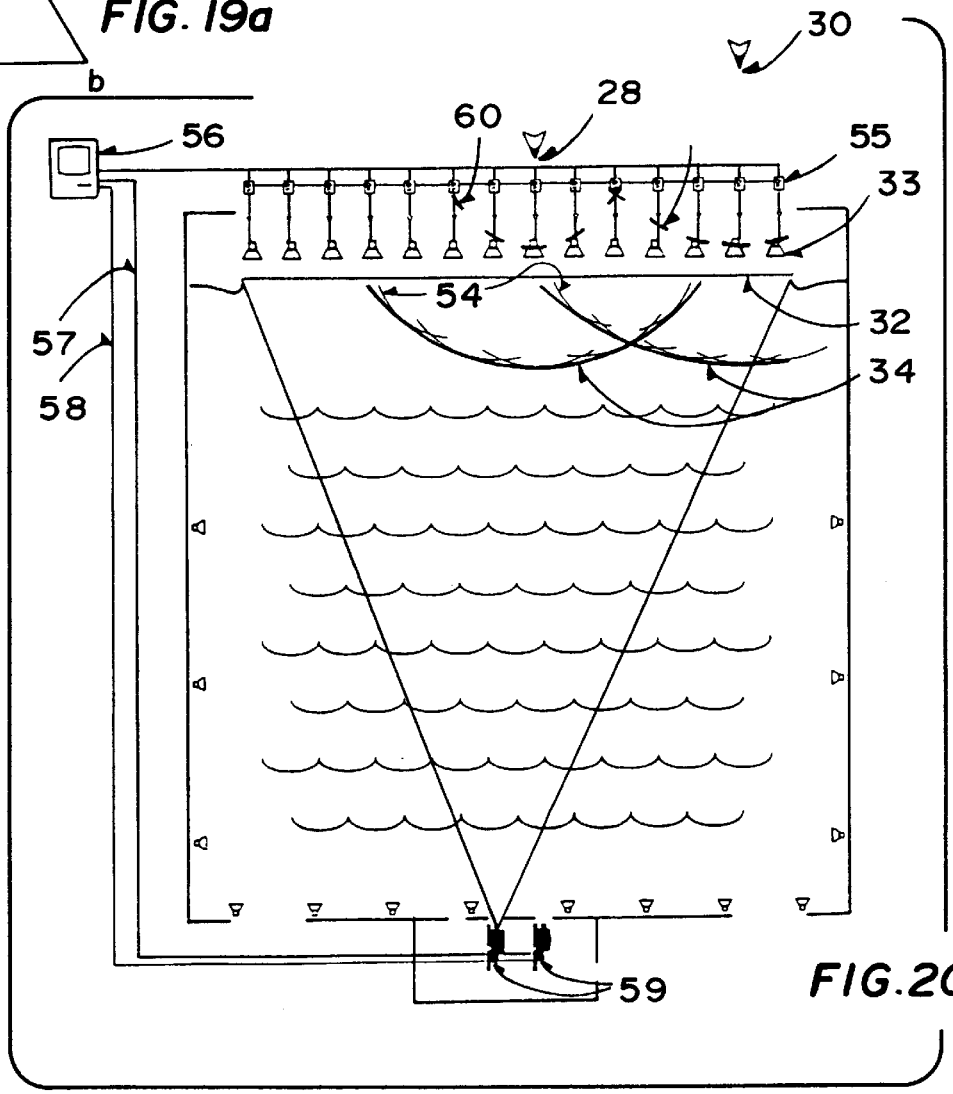
FIG. 20 shows a diagrammatic plan of a hypothetical cinema with a loudspeaker array, virtual point sources and means for activating individual speakers in accordance with delay information which is recorded on the cinematic film.

Control of a time-delay delta t which regulates the appropriate time for each speaker, is calculated with reference to FIGS. 19 and 19*a*. Speakers 33, labelled a and b respectively are shown as part of the planar array shown in FIGS. 18 and 20. A virtual point source 28, labelled p is directly behind the speaker a, so that a sound wavefront emanating from the point p and expanding as a regular sphere, first breaks the plane of the array 33 at the point a. Thus, speaker a should be activated just at the time when an expanding sound wavefront from p, or source point 28, would reach the point a in array 33. Activation of b (which is to say, of each other speaker at its time, in the array 33) is dependent upon the delay necessary for the expanding sound wavefront from p to pass the speaker plane at the point where b is located. Thus, viewing the points pab as a right triangle, one observes that the time for activation of b corresponds to the hypotenuse bp while the time for activation of a corresponds to the adjacent side (with respect to the angle bpa). If pa equals one, then the delay delta t for activation of b is secant bpa (hypotenuse/adjacent) minus 1, divided by the speed of sound, as noted above.

One notes that for convenience I have chosen p directly behind the speaker a, which in practice is unlikely. Thus, there would normally be a point a in the speaker plane orthogonal to the point p, which would not be central to one of the speakers 33. Hence, while no speaker would be activated at a precise instant of the impingement of the hypothetical sound wavefront 34 on the plane of the array 33, each speaker's appointed activation time is calculated with respect to that point a. Hence, all speakers in the array may be thought of as having a nonzero delta t.

Thus, activating the sound feed to each individual speaker in array 33 in accordance with its respective delta t delay, may be seen in FIG. 20 to produce first and second superimposed sound wavefronts 34 which correspond respectively to wavefronts which would appear (or be heard) to have originated respectively at virtual source points 28 and 30.

In cinematic practice projectors 59 (FIG. 20) project a scene upon a screen 32 which corresponds to a film frame such as that shown in FIG. 11*a,* which contains two virtual source points 28, 30. Data recorded adjacent to the film frame is relayed to a computer 56, comprising a positioning data track 57 and a normal sound track 58.

With respect to any particular frame the positioning data track 57 provides to the computer 56 the desired point p information and the beginning and ending times for particular sounds. The computer 56 calculates delta t for each speaker in the array 33 and feeds the soundtrack signals at the appointed time to each speaker in turn, thus providing superimposed wavefronts 34 coordinated with the virtual source points for each sound and each frame in the film.

Since the film screen 32 is located directly forward of the array 33, any psychoaccoustic virtual point source 28, 30 may be made to correspond to a visual spatial position as perceived on the screen.

The sound track 58 may consist of a plurality of forward channels, i.e. for loudspeakers located behind the screen, each corresponding to a different virtual sound source, i.e. a different point p and each being delivered to its corresponding set of speakers in the array 33 according to the respective delta t delays, as necessary to correspond to complex scenes involving multiple, and simultaneous, sounds and sources.

Of course, this system may also be used with a simple mono forward channel, e.g. the center channel in a Digital Dolby System 5.1, or its equivalent.

I claim:

1. A structural unit comprising two pairs of hinging edge members, said hinging edge members defining substantially straight hinging edges, and at least extensions of said hinging edges meeting at a vertex lying on the longitudinal axis of said structural unit, and said hinging edge members having means for mounting hinge means thereon, said hinging edge members being disposed at opposite ends of said structural unit along said longitudinal axis such that each pair of said hinging edges is disposed orthogonally with respect to the other of said pair of hinging edge members when viewed along said longitudinal axis, means for holding said two pairs of hinging edge members in rigid juxtaposition to one another, each of said hinging edges of said pair of hinging edge members being disposed at an angle of substantially 108.55° from the other hinging edge of said pair, and each said hinging edge being disposed at an angle of substantially 54.27° from said longitudinal axis.

2. The structural unit of claim 1 comprising the two pairs of hinging edge members disposed at opposite ends of a rigid connecting member.

3. The structural unit of claim 1 comprising a closed polyhedron of sixteen sides, each of said sides being an equilateral triangle.

4. A four unit compound lever comprising four identical structural units as in claim 1, each of said identical structural units having two hinging edge members at each end of said identical structural units, one of said hinging edge members at a first end of a first one of said identical structural units, being hinged to one of said hinging edge members at a first end of a second one of said identical structural units, one of said hinging edge members at the second end of said second identical structural unit being hinged to one of said hinging edge members at a first end of a third identical structural unit, one of said hinging edge members at the second end of said third identical structural unit being hinged to one of said hinging edge members at a first end of a fourth identical structural unit, and one of said hinging edge members at the second end of said fourth identical structural unit being hinged to one of said hinging edge members at the second end of said first one of said identical structural units, each of said first and second ends of each of said structural units having one hinged hinging member and one free hinging member.

5. An eight-unit compound lever comprising a first and a second four-unit compound lever of claim 4 with free hinging members of two contiguous identical structural units of said first four-unit compound lever being hinged together with free hinging members of two contiguous structural units of said second four-unit compound lever, thus forming four mutually contiguous central identical structural units, two from said first four-unit compound -lever and two from said second four-unit compound lever, said longitudinal vertices of each of said four mutually contiguous structural units meeting at a common point, with longitudinal vertices of each of the other three mutually contiguous structural units, and each of said four mutually contiguous structural units having three of its four hinging members hinged and one of its four hinging members free.

6. A twelve-unit compound lever comprising the eight-unit compound lever of claim 5 and further comprising two sets of two identical structural units of claim 1, each of said sets of two identical structural units having a hinging edge member of a first end of a first structural unit hinged to a hinging edge member of a first end of a second structural unit, and a hinging edge member of each of the second ends of each of the two identical structural units hinged to one of said free hinging edge members of said four mutually contiguous structural units of said eight-unit compound lever.

* * * * *